United States Patent [19]

Smith

[11] 3,995,382

[45] Dec. 7, 1976

[54] INSTEP GUARD FOR SAFETY SHOES

[75] Inventor: Roy A. Smith, Red Wing, Minn.

[73] Assignee: Red Wing Shoe Compnay, Inc., Red Wing, Minn.

[22] Filed: Oct. 22, 1975

[21] Appl. No.: 624,659

[52] U.S. Cl. ..... 36/72 R

[51] Int. Cl.[2] ..... A43B 13/22

[58] Field of Search ..... 36/72 R

[56] References Cited

UNITED STATES PATENTS

| | | | |
|---|---|---|---|
| 3,175,292 | 3/1965 | MacQuiad et al. | 36/72 R |
| 3,561,142 | 2/1971 | Streit et al. | 36/72 R |
| 3,841,004 | 10/1974 | Gray et al. | 36/72 R |

*Primary Examiner*—Patrick D. Lawson

*Attorney, Agent, or Firm*—Merchant, Gould, Smith, Edell Welter & Schmidt

[57] ABSTRACT

A protective accessory designed for application to the outside of a safety boot, and the combination of the accessory with the boot. The accessory includes a scuff top, for protecting the boot toe, to which a metatarsal cap may be hinged to give added protection to the boot wearer.

5 Claims, 4 Drawing Figures

FIG. 1
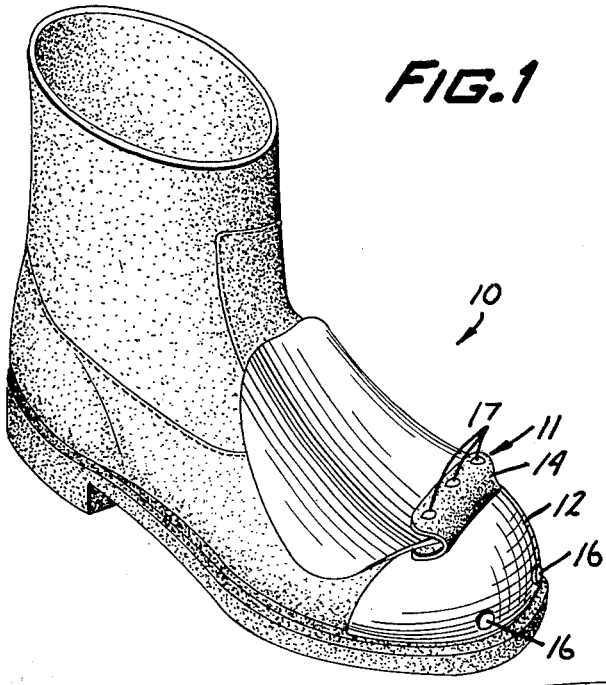
FIG. 2
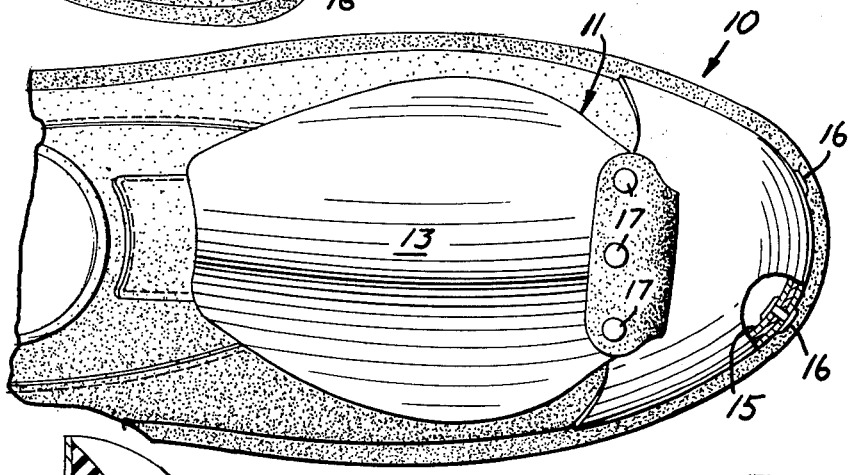
FIG. 3
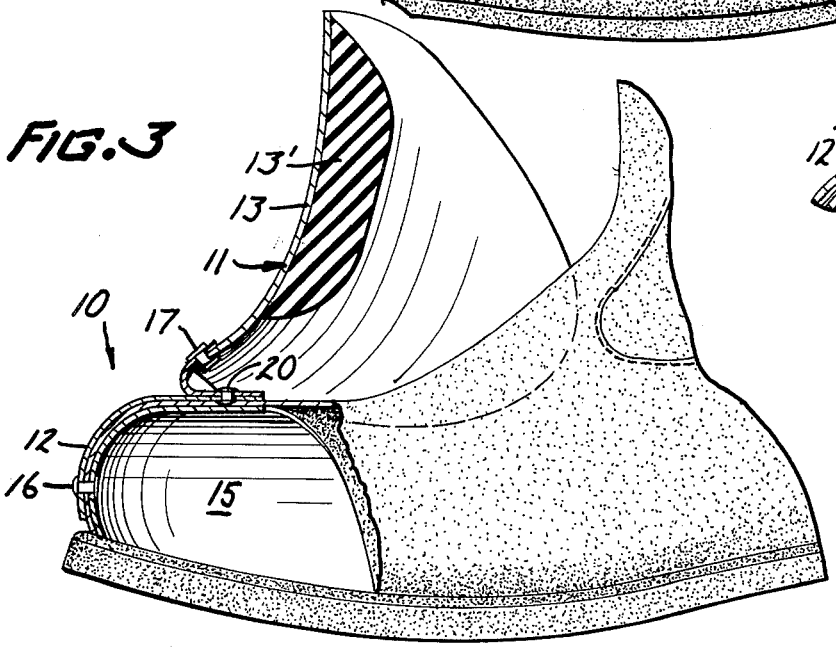
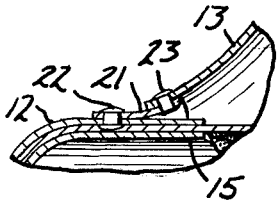
FIG. 4

INSTEP GUARD FOR SAFETY SHOES

BACKGROUND OF THE INVENTION

This invention relates to the general field of footwear, and in particular comprises a new protective accessory for use with safety boots of known structure, and to the combination of that accessory with such a boot.

It is known to provide protective footwear for workmen in hazardous occupations. In addition to being quickly removable, in case of entrance of hot or otherwise injurious material, protective boots of this sort generally have a rigid toe-protecting cap built into the toe of the boot, and may also have a metatarsal cap for protecting the arch of the wearer against impact. For convenient donning and doffing of the boot, any metatarsal cap must be hinged or otherwise yieldably associated with the rest of the boot.

Heretofore, boot design has always included any metatarsal cap as a built in feature, like the toe cap, and the manufacturer has been required to maintain stocks of two complete lines, one with the metatarsal cap and the other without it, as this protection is necessary only for workers in some industries, and their greater cost is not justified in other industries.

It has also been noticed that when workmen wear boots with internal protective toe caps, they are much more careless in how they walk, what they kick, and so forth. This in fact extends so far that the boots frequently must be discarded because of worn toe caps while they are otherwise in serviceable condition.

SUMMARY OF THE INVENTION

My invention comprises a scuff top designed to be added on the outside of a boot, to prevent damage to the leather of the toe, and arranged to hingedly support a metatarsal cap where such added protection is desired. The manufacturer now need only stock a single line of boots, applying a metatarsal cap externally by the intermediary of the scuff top when orders for boots with the added protection are received.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing, FIG. 1 is a perspective view of a protective boot embodying my invention, showing the parts in a first position;

FIG. 2 is a fragmentary plan view of the structure to a larger scale;

FIG. 3 is a side view partly in section of the structure of FIG. 2 showing the parts in a second position; and FIG. 4 is a fragmentary view like FIG. 3 showing a modification.

DESCRIPTION OF THE PREFERRED EMBODIMENT

In the drawing, a boot 10 is shown as equipped with my protective accessory 11, which comprises a scuff top 12, to which a metatarsal cap 13 is connected by a leather hinge 14. The boot has a built-in protective metal toe cap 15, and my accessory 10 is connected to the boot by rivets 16 passing through the front edge of scuff top 12 and the front of toe cap 15. Members 12 and 13 are of metal or suitable impact resisting plastic and the latter is provided with suitable padding 13'. Hinge 14 is secured to cap 13 by rivets 17, and to the boot by rivets 20 passing through the top edge of toe cap 15. It will be apparent that by this arrangement, the rivets are located where they will not contact the body of the wearer.

FIG. 4 shows a modification of the invention in which leather hinge 21 is slightly differently oriented, and is connected to boot 10 by rivets 22 passing through the edge of toe cap 15, and to metatarsal cap 13 by rivets 24.

It will be apparent that boot 10 is complete and salable without device 11, and gives toe protection by means of cap 15. If metatarsal arch protection is desired, my accessory 11 is secured to the boot without any other change, scuff top 12 giving some redundant protection to the wearer but principally protecting the boot toe. If only boot toe protection is desired, scuff top 12 may be provided without metatarsal cap 13.

From the foregoing it will be evident that I have invented a new accessory for use with safety boots, which gives added protection to both the wearer and to the boot itself, and which may be added to an unmodified boot and thus cut down the stock required to be carried by boot manufacturers.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

What is claimed is:

1. A protective accessory for a boot comprising, in combination:

a padded, rigid metatarsal cap having a general configuration of a saddle and extending from a lower front edge to an upper rear edge;

a rigid scuff top, configured for application to the outside of the toe of a boot, and having a rear edge to arch over said toe and a front edge curved to engage said toe;

a hinge of pliable material having a central hinging portion and first and second edges spaced from said central portion;

first fastening means securing one edge of said hinge upon the outer surface of said scuff top along said rear edge thereof;

and second fastening means securing the other edge of said hinge along said lower front edge of said metatarsal cap to form a complete protective assembly adapted to be fastened to a boot by fasteners passing through said front edge of said scuff top into the toe of the boot.

2. The structure of claim 1 in which said hinge comprises a central fold portion and upper and lower edges extending away from said fold portion in generally the same direction, said first fastening means securing said lower edge of said hinge upon the upper surface of said scuff top along its rear edge, so that said fold is in front of said fastening means, and said second fastening means securing said upper edge of said hinge along the outer surface of said lower front edge of said metatarsal cap.

3. The structure of claim 1 in which said hinge has a central fold portion and opposite edges extending in opposite directions from said fold portion, said first fastening means securing one edge of said hinge upon the upper surface of said scuff top at its rear edge, and said third fastening means securing the other edge of said hinge along the inner surface of said lower front edge of said metatarsal cap.

4. In combination, a boot having a sole and an upper with a toe having a rigid internal protective toe cap built therein, and a protective accessory secured to said boot along the front lower edge of said toe and including a rigid scuff top, configured for application to the outside of the toe of the boot, a padded, rigid metatarsal cap, and means hingedly interconnecting said scuff top and said metatarsal cap.

5. The structure of claim 4 in which said protective accessory comprises, in combination:

said metatarsal cap having the general configuration of a saddle and extending from a lower front edge to an upper rear edge;

said scuff top having a rear edge to arch over said toe and a front edge curved to engage said toe;

a hinge of pliable material having a central hinging portion and first and second edges spaced from said central portion;

first fastening means securing one edge of said hinge upon the outer surface of said scuff top along said rear edge thereof;

and second fastening means securing the other edge of said hinge along said lower front edge of said metatarsal cap to form a complete protective assembly adapted to be fastened to a boot by fasteners passing through said front edge of said scuff top into the toe of the boot.

* * * * *